United States Patent [19]

Gaglione et al.

[11] 4,275,367

[45] Jun. 23, 1981

[54] DIGITAL DIODE PHASE SHIFTER ELEMENTS

[75] Inventors: Stanley Gaglione, New Hyde Park; Gerard L. Hanley, Melville, both of N.Y.

[73] Assignee: Sperry Corporation, New York, N.Y.

[21] Appl. No.: 121,187

[22] Filed: Feb. 13, 1980

[51] Int. Cl.[3] ..... H01P 1/185; H01P 3/08

[52] U.S. Cl. ..... 333/164; 333/161; 333/246

[58] Field of Search ..... 333/138–139, 333/156–157, 160–161, 164, 245–248, 262; 343/778, 854

[56] References Cited

U.S. PATENT DOCUMENTS

| | | | |
|---|---|---|---|
| 3,246,265 | 4/1966 | Smith-Vaniz | 333/164 X |
| 3,909,751 | 9/1975 | Tang et al. | 333/262 X |

*Primary Examiner*—Marvin L. Nussbaum

*Attorney, Agent, or Firm*—Howard P. Terry

[57] ABSTRACT

A high frequency diode digital phase shifter element of the transmission line type has a capacitor coupled serially in a primary transmission line conductor. Two shunt switchable elements are coupled by the series capacitor. The switchable element includes short-circuitable lengths of transmission line whose effective electrical lengths can be varied by simultaneously changing the biased state of shunt mounted PIN diodes.

14 Claims, 9 Drawing Figures

FIG.1.
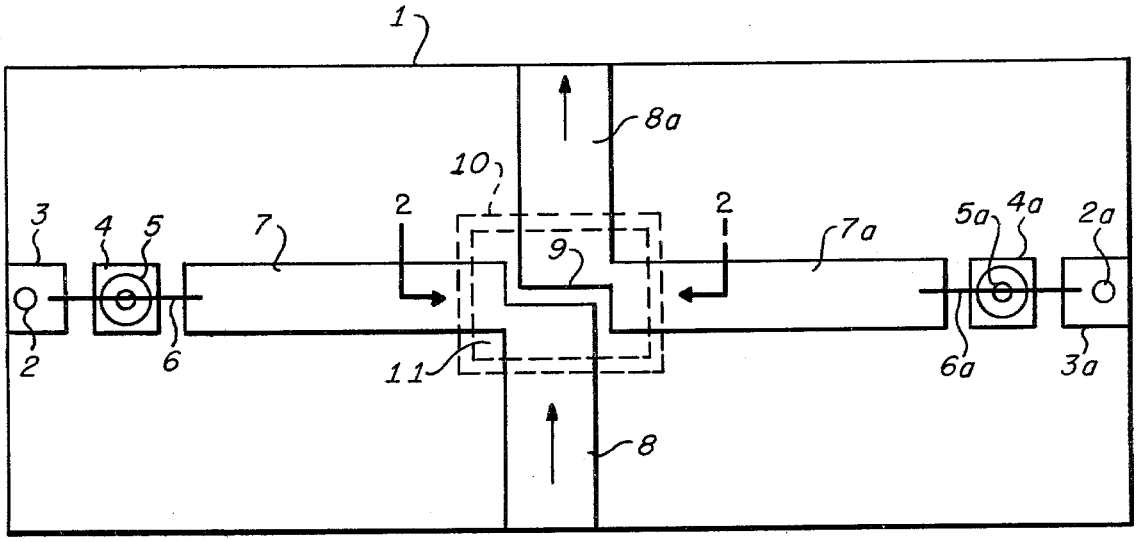
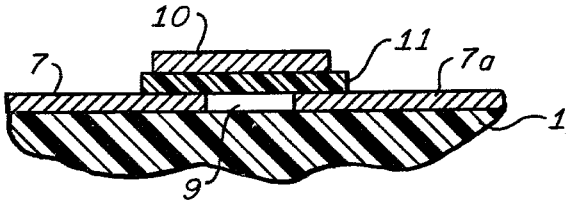
FIG.2.
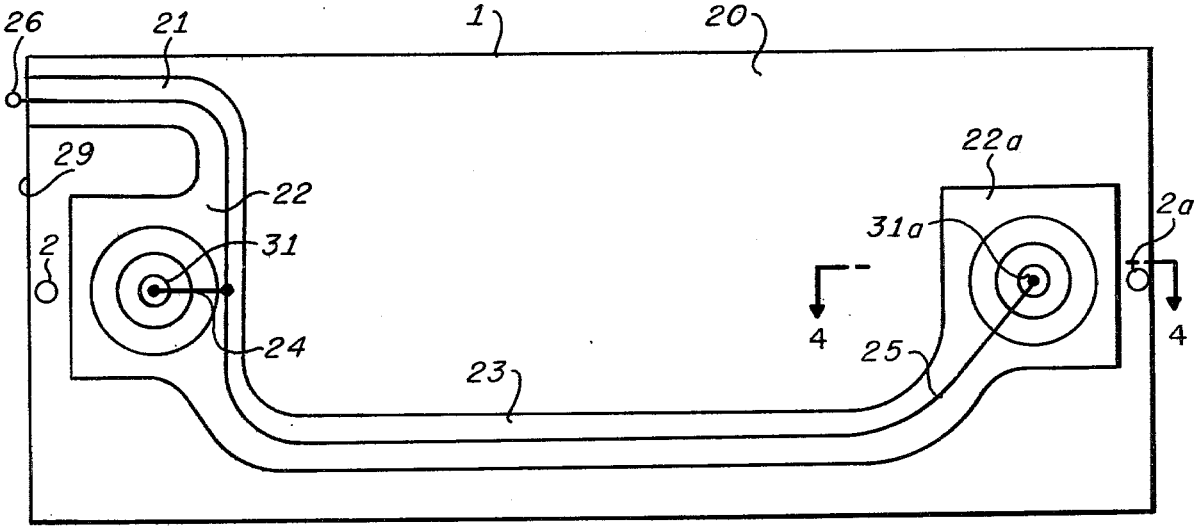
FIG.3.

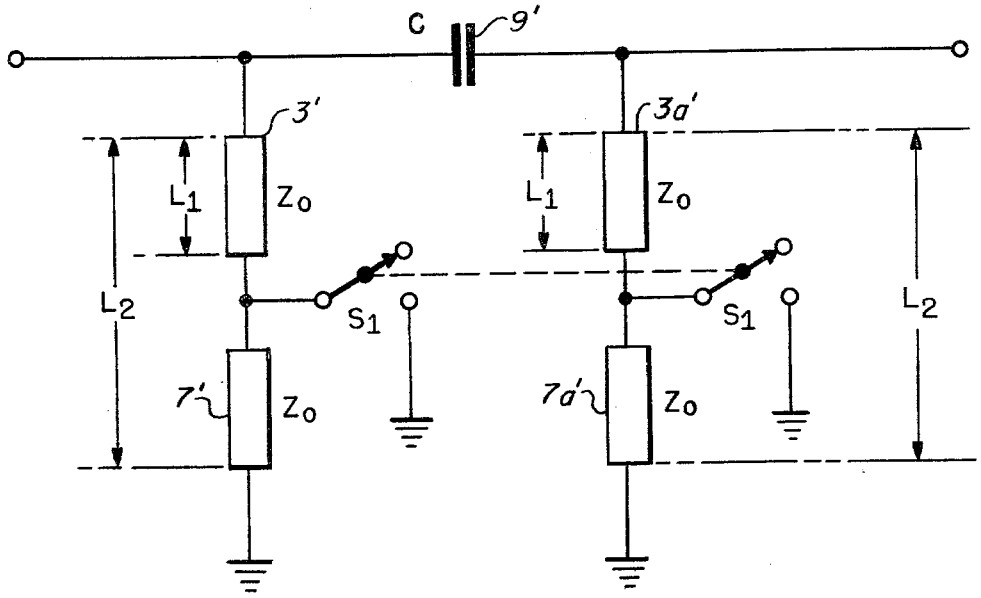
FIG. 6.
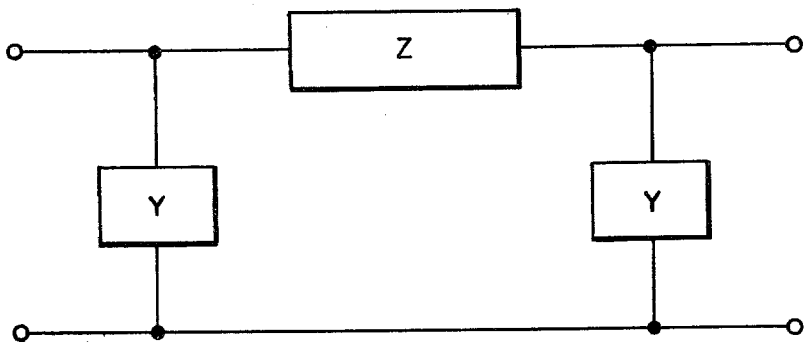
FIG. 7.
VALUES OF $\mathcal{H}L_1$, $\mathcal{H}L_2$, AND b
FOR COMMON PHASE SHIFTS
| PHASE SHIFT DEGREES | $L_1$ DEGREES | $L_2$ DEGREES | b |
|---|---|---|---|
| 90 | 22.5 | 67.5 | 1.414 |
| 45 | 33.75 | 56.25 | 1.080 |
| 22.5 | 39.375 | 50.625 | 1.020 |
| 11.25 | 42.1875 | 47.8125 | 1.0048 |
FIG. 9.

(1) $Z = 1 / j\omega C$ (2) $Y = -Y_0 j \cot \mathcal{H} L_{1,2}$ (3) $$\begin{bmatrix} A & B \\ C & D \end{bmatrix} = \begin{bmatrix} 1 & 0 \\ Y & 1 \end{bmatrix} \bullet \begin{bmatrix} 1 & Z \\ 0 & 1 \end{bmatrix} \bullet \begin{bmatrix} 1 & 0 \\ Y & 1 \end{bmatrix} = \begin{bmatrix} (1+ZY) & Z \\ Y(2+YZ) & (1+ZY) \end{bmatrix}$$

(4) $$Z_{in} = \frac{AZ_0 + B}{CZ_0 + D}$$

(5) $X^2 \quad -2bX + 1 = 0$ (6) $X = \cot \mathcal{H} L_{1,2}$ (7) $b = \omega C Z_0$ (8) $\cot \mathcal{H} L_1 = b + \sqrt{b^2 - 1}$ (9) $\cot \mathcal{H} L_2 = b - \sqrt{b^2 - 1}$

(10) $b = \frac{1}{2} (\cot \mathcal{H} L_1 + \cot \mathcal{H} L_2)$

(11) $\cot \mathcal{H} L_1 = (\cot \mathcal{H} L_2)^{-1}$

(12) $\mathcal{H} L_1 + \mathcal{H} L_2 = 90^\circ$

(13) $\psi = 2 (\mathcal{H} L_2 - \mathcal{H} L_1)$

FIG. 8.

DIGITAL DIODE PHASE SHIFTER ELEMENTS

BACKGROUND OF THE INVENTION

1. Field of the Invention

The invention pertains to high frequency phase shifter elements and more particularly to digital diode phase shifter elements of the transmission line type wherein a capacitor is coupled serially in the primary transmission line conductor.

2. Description of the Prior Art

In modern high frequency radar and communication systems, the antenna pattern must be moved at very rapid rates and this is normally achieved in array antennas by use of a matrix of small radiators whose radiation phases are systematically and electronically varied. The necessary phase gradients across the antenna are usually generated in discrete steps by a plurality of such electronic phase shifter elements.

A major handicap in the past phase shifter elements has been in the inability exactly to reproduce the diodes upon which the characteristics of the diode phase shifter elements are significantly dependent. However, this problem has been essentially solved by semiconductor manufacturers, so that attention turns to the improvement of the phase shifter elements themselves. The design of the present phase shifter element permits it beneficially to be physically smaller than conventional elements of the loaded transmission line type, for example. The invention avoids the use of complex implementation, none of the prior art very high impedances and no very low impedance lines being required, so that a satisfactory, non-critical high frequency structure on one side of the element is readily achieved. No fine conductor lines are required as in reflective phase shifters using directional couplers. As well as calling for simpler high frequency circuits, the low frequency and bias control arrangements are all disposed on the second or grounded side of the element. The novel phase shifter element is also found to possess fully adequate band width for use in electronically steerable, phased array antennas and in kindred applications.

SUMMARY OF THE INVENTION

The present invention is a high frequency diode digital phase shifter element of the transmission line type wherein a capacitor is coupled serially in a primary transmission line conductor. Two shunt switchable elements are coupled by the series capacitor. The switched elements include short-circuitable lengths of transmission line whose effective electrical lengths are varied by changing the biased state of shunt mounted PIN diodes between first and second states.

High frequency signals injected into the phase shifter element at an input node are transmitted to a symmetrically disposed output node in a matched transmission line sense. The insertion phase characteristic of the element changes when the bias on the diodes is differentially changed from reverse to forward bias to provide the desired incremental phase shift. The transmission line characteristics of the element are reciprocal.

BRIEF DESCRIPTION OF THE DRAWINGS

FIG. 1 is a plan view of the novel phase shifter element.

FIG. 2 is a partial cross-section elevation view of a portion taken along the line 2—2 of FIG. 1.

FIG. 3 is a view of the side of the apparatus opposite to that shown in FIG. 1.

FIGS. 6 and 7 are simplified versions of FIG. 5 useful in explaining the operation of the invention.

FIG. 8 is a set of equations used in explaining the invention.

FIG. 9 is a table illustrating parameters of representative phase shifters according to the invention.

DESCRIPTION OF THE PREFERRED EMBODIMENTS

Figure 4:
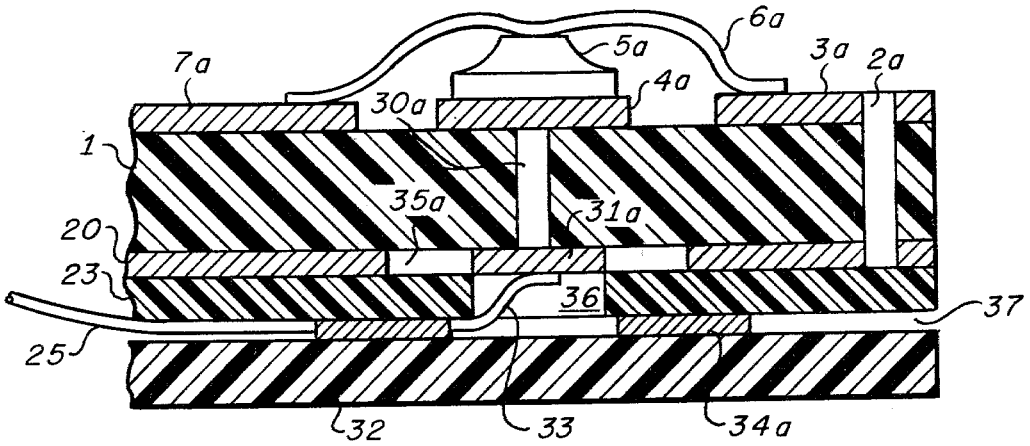
FIG. 4 is a partial cross-section elevation view of a portion of FIG. 3 taken along the line 4—4 of FIG. 3.

FIG. 1 illustrates one embodiment of the novel elemental planar symmetric digital diode high frequency phase shifter element employing microstrip transmission line. Based in the usual manner on a substrate 1 of alumina ($Al_2O_3$), the series high frequency conducting circuit of the phase shifter element includes an input arm 8 and an output arm 8*a*. These designations may be reversed, since the novel phase shifter has reciprocal characteristics. A series capacitor 9 is formed by a gap separating arms 8,8*a*.

The structure is generally symmetric about arms 8,8*a*. For example, input arm 8 is coupled to a transmission line section 7 lying on substrate 1 and perpendicular to and conductively coupled to input arm 8. Two short conducting pads 3 and 4 are aligned with transmission line 7 and are normally deposited in the same operation as line 7. Pad 4 is the site of a high frequency diode 5, which may be a PIN diode such as that manufactured by Microwave Associates of Burlington, Mass., under the code number MA-4P404. Pad 3 is coupled through substrate 1 in the manner shown at 2*a* in FIG. 4, as will be further discussed, to be coupled to electrically conductive ground plane 20 on the side of substrate 1 opposite transmission line 8,8*a*. A conductive wire 6 connects pad 3, one electrode of diode 5, and the end of primary transmission line section 7 adjacent diode 5. In like manner, output arm 8*a* is coupled to a transmission line section 7*a* lying on substrate 1 and perpendicular to and conductively joined to output arm 8*a*. Two short conducting pads 3*a* and 4*a* are aligned with primary transmission line 7*a*. Pad 4*a* is the site of a high frequency diode 5*a* similar to diode 5. Pad 3*a* is coupled through substrate 1 to ground plane 20. A conductive wire 6*a*, similar to wire 6, is used to connect pad 3*a*, one electrode of diode 5*a*, and the end of transmission line 7*a* facing diode 5*a*. The capacitive coupling across gap or condenser 9 may, as shown in FIGS. 1 and 2, be increased by an overlying layer 11 of a dielectric material such as silica ($SiO_2$). Depending upon the method used to deposit dielectric layer 11, it may extend into gap 9, filling that void. Further to enhance the capacitive effect, a film 10 of a conducting material such as copper may be deposited on the external surface of silica film 11.

Conventional methods may be used to deposit the conductive and dielectric patterns on substrate 1, including thin or thick film deposition methods. For example, substrate 1 may first be cleaned by plasma bombardment; a thin film of chromium or of a nickel-chromium alloy assuring adherence to substrate 1 may be deposited by sputtering through an appropriate mask, this layer then being covered by a relatively thicker film of copper, silver, or gold. Similar methods may be used for silica deposition as have enjoyed success in the past. Diodes 5,5*a* may be affixed to the respective pads 4,4*a* by use of conductive epoxy resin film, for example, and wires 6,6*a* may be connected by normal thermocompression bonding methods.

The high frequency circuits of the device appear on the surface seen in FIG. 1, while the low frequency bias parts of the circuit are seen in FIG. 3 and are located on the opposite surface of substrate 1, which opposite surface is widely covered by electrically conductive ground plane 20. Referring to FIGS. 3 and 4, it is seen that conductors 2,2*a* couple the respective pads 3,3*a* to ground plane 20. Furthermore, one electrode of each of diodes 5,5*a* is connected through substrate 1; in the case of diode 5*a*, for example, the coupling conductor 30*a* connects pad 4*a* to a disk 31*a* as shown in FIG. 4. A ring-shaped void 35*a* surrounds disk 31*a*, isolating it from the main body of ground plane 20. A dielectric film, which may be made of silica and having the specially shaped pattern shown in FIG. 3, is deposited over part of ground plane 20. The dielectric film includes a region 22*a* about disk 31*a* with a hole for access thereto, a strip 23, a region 22 about disk 31 with a hole for access thereto, and a strip 21 reaching one edge 29 of substrate 1 at terminal 26.

The shaped dielectric film including regions 22*a*, 23, 22, 21 supplies an insulating base for a branching conductor system (FIG. 3) for coupling bias signals through coupling conductors such as conductor 30*a*. For this purpose, the wire 25 may be affixed to a washer-shaped capacitive plate 34*a*, with lead 33 connecting plate 34*a* to disk 31*a*. Wire 25 is placed against the external face of dielectric strip 23 and extends in a similar fashion to an external bias source (not shown) connected to terminal 26. In a similar way, disk 31 associated with diode 5 also form a junction with wire 25. Wires 24,25 may finally be protected and insulated from their environment by the application of a second layer 32 of silica over the first layer 22*a*, 23, 22, 21. The voids at 35,36, and 37 may also simultaneously be filled with insulating material and normally would be so filled. In place of the branching wires 24,25 their functions may be performed by a deposited strip conductor system employing the general techniques used to form conductors 7, 7*a*,8,8*a*, et cetera.

It will be understood that the dimensions and proportions shown in the drawings would not necessarily be those selected in the practice of the invention by those skilled in the art. The dimensions and proportions illustrated are selected, on the other hand, as is the usual custom, to illustrate the invention most clearly.

Figure 5:
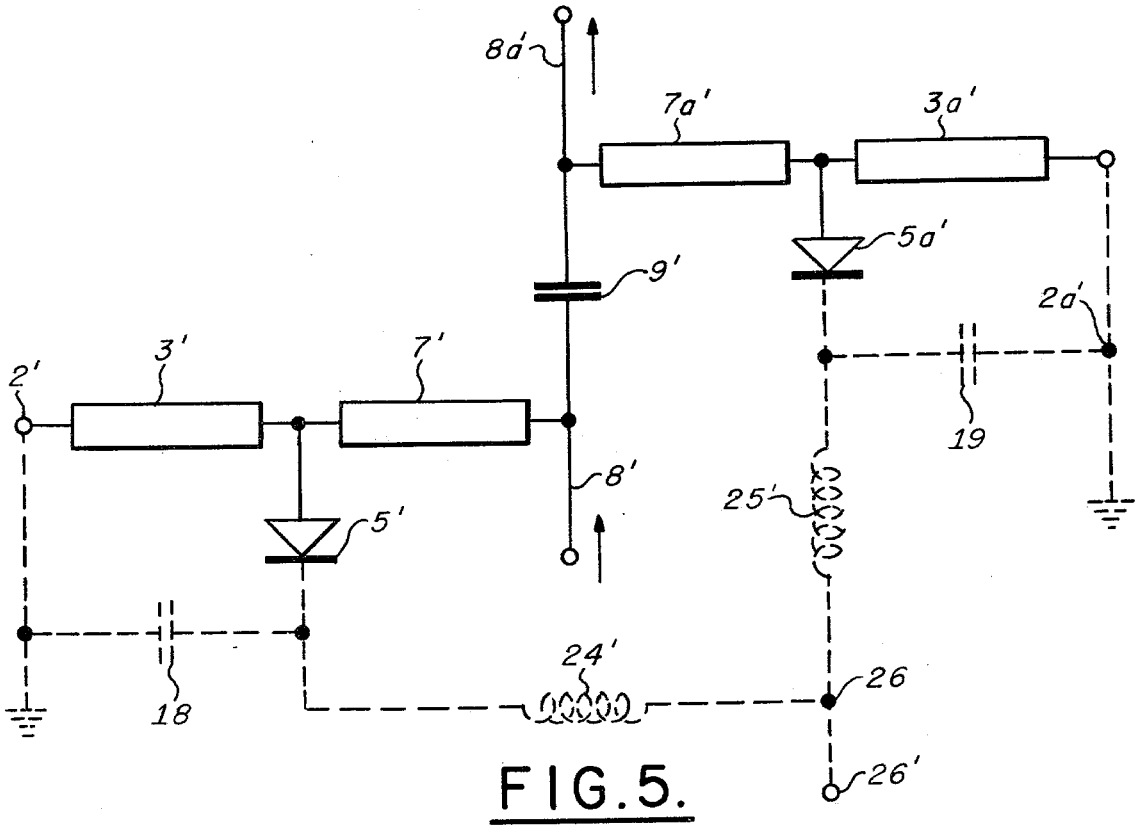
FIG. 5 is an equivalent circuit of the novel phase shifter element.

FIG. 5 illustrates the equivalent circuit of the novel phase shifter element. High frequency parts of the circuit found on the FIG. 1 side of the device are shown in solid lines in FIG. 5 and are identified by primed reference numbers corresponding to those of FIG. 1. Other parts of the circuit, found on the FIG. 3 side of the device, are shown in dotted lines and are similarly identified by primed reference numbers corresponding to those used in FIG. 3. Capacitors 18 and 19 in FIG. 5 correspond to those found between the respective flat ring electrodes 34 and 34*a* and ground plane 20 (FIG. 4). Inductances 24', 25' of FIG. 5 represent the effective high frequency inductances of leads 24,25 of FIG. 3.

For providing a better understanding of the novel features of the invention, the circuit representation in FIG. 5 is readily converted into the equivalent circuit of FIG. 6 when low frequency or bias circuit elements are eliminated. The purpose of this step and of the analysis now to be made is to determine the preferred relationship between the circuit parameters, the phase shifts, and the conditions for matched transmission of high frequency signals in the invention.

For simplicity, diodes 5', 5*a'* of FIG. 5 are replaced in FIG. 6 by equivalent ganged mechanical switches $S_1$ and $S_2$, the bias circuit also being eliminated in FIG. 6. The basic readily acceptable assumptions used in the analysis are:

(a) all transmission lines are substantially lossless,
(b) the load and generator impedances are real and equal to the characteristic impedance $Z_o$ of the transmission lines, where $Z_o = 1/Y_o$, and
(c) switches $S_1$ and $S_2$ are always simultaneously in the same state.

In FIG. 6, it is seen that the effective transmission lines 3' and 3*a'* each have a characteristic impedance of $Z_o$ and lengths $L_1$. Also, the effective transmission lines 3', 7' and 3*a*, 7*a'* each have the same characteristic impedances $Z_o$ and total lengths $L_2$.

Now, it is seen that the schematic circuit of FIG. 6 may correctly be replaced by the even simpler pi equivalent circuit shown in FIG. 7. In FIG. 7, the series impedance Z is equal to the impedances of the series capacitor 9', as defined in the usual manner by Equation (1) of FIG. 8. Each shunt admittance Y has either of two values, depending upon the position of its associated switch $S_1$ or $S_2$, as defined in the usual manner in Equation (2) of FIG. 8. In Equation (2), the subscript 1 applies when a switch is conducting and 2 applies when that switch is non-conducting. The value Y is the admittance of a short-circuited length of transmission line. The value $\omega$ is the radian operating frequency, while $\kappa$ is the propagation constant in radians per unit length. Among known methods of analyzing distributed transmission line devices when lumped elements are introduced are four different matrix methods, of which the well known generalized circuit constants matrix or ABCD matrix method is presently preferred. The ABCD matrix method, in which lumped and distributed elements are related to matrix elements quite simply, also permits cascading of elements simply by multiplying their matrices. For example, the pi equivalent network of FIG. 7 can be represented by the ABCD matrix of Equation (3) in FIG. 8. For matched transmission, the input impedance of the pi network must be equal to the value $Z_o$ for both values of Y; i.e., whether switches $S_1$ and $S_2$ are closed or open.

On the basis of the fundamental definitions on which the ABCD matrix method is established, it can readily be shown that the input impedance $Z_{in}$ of the pi network is defined by Equation (4). Substituting the values of A, B, C, and D derived by analogy with the pi network, equating $Z_{in}$ to $Z_o$, and separating real and imaginary parts, Equation (5) is generated. In Equation (5), the values X and b are respectively defined in the usual manner by Equations (6) and (7). The value b is then the normalized susceptance of capacitor 9'.

The quadratic Equation (5) can be solved readily for X in terms of b, yielding the companion Equations (8) and (9). These equations show that, for each value of b, there are two transmission line lengths $L_1$ and $L_2$ for which propagation through the network is actually matched. Simple addition of Equations (8) and (9) yields the first design equation for the novel phase shifter element (Equation (10)).

It may readily be demonstrated that $b+\sqrt{b^2-1}$ is the actual reciprocal of $b-\sqrt{b^2-1}$. This fact results in the correlary expressed by Equation (11) from which Equation (12) immediately follows, representing the second important design equation.

The third design equation relates the phase shift of the phase shifter element to $L_1$ and $L_2$; this phase shift $\psi$ is given by Equation (13) of FIG. 8, which may be derived, for example, by solving for the change in transmission line transmission factor angle. Since the desired phase shift angle $\psi$ is known, Equations (12) and (13) are solved simultaneously for $\kappa L_1$ and $\kappa L_2$ and therefore yield $L_1$ and $L_2$. The value of b is then found from Equation (10) and thence the value of capacitance C is found from Equation (7). FIG. 9 shows typical values to be used to obtain phase shifts commonly used in practice in practical phase shifter elements.

While the invention has been described in its preferred embodiments, it is to be understood that the words which have been used are words of description rather than of limitation and that changes within the purview of the appended claims may be made without departing from the true scope and spirit of the invention in its broader aspects.

What is claimed is:

1. Phase shifter means comprising:

substrate means having first and second opposed sides, first and second generally collinear microstrip transmission line means disposed on said first opposed side, capacitive gap means formed at said substrate means by gap means between adjacent ends of said first and second generally collinear microstrip transmission line means, third and fourth generally collinear microstrip transmission line means disposed on said substrate means substantially at right angles to said first and second generally coollinear microstrip transmission line means, said first generally collinear microstrip transmission line means being conductively joined to said third generally collinear microstrip transmission line means at said capacitive gap means, and said second generally collinear microstrip transmission line means being conductively joined to said fourth generally collinear microstrip transmission line means at said capacitive gap means, ground plane means disposed on the second opposed side of said substrate means, first and second diode means each having respective first and second diode electrode means coupled to ends of said third and fourth generally collinear microstrip transmission line means opposite said capacitive gap means through said substrate means whereby simultaneously to receive a predetermined bias voltage, the respective first and second diode electrode means being additionally directly coupled by conductor means to said ground plane means.

2. Apparatus as described in claim 1 wherein said first and second and said third and fourth generally collinear microstrip transmission line means are covered with dielectric layer means extending at least thereover at said capacitive gap means.

3. Apparatus as described in claim 2 further including conductive layer means affixed to said dielectric layer means in insulated relation with respect to said first, second, third, and fourth generally collinear microstrip transmission line means.

4. Apparatus as described in claim 3 wherein said first and second diode electrode means are additionally capacitively coupled to said ground plane means.

5. Phase shifter means comprising: substrate means having first and second opposed sides, ground plate means disposed on said first opposed side, transmission line apparatus disposed on said second opposed side including:

capacitor means, input transmission line means coupled to said capacitor means, output transmission line means coupled to said capacitive means opposite said input transmission line means, first and second branching transmission line means respectively directly coupled to said respective input and output transmission line means at said capacitor means, first and second diode means coupled to said first and second branching transmission line means opposite said capacitor means through said substrate means to said ground plane means whereby a predetermined bias voltage may be coupled across said diode means, and third and fourth transmission line means coupled to said first and second branching transmission line means and to said diode means through said substrate means to said ground plane means.

6. Apparatus as described in claim 5 wherein said substrate means comprises planar dielectric insulating means.

7. Apparatus as described in claim 5 wherein said capacitor means is formed in part by adjacent ends of said input and output transmission line means generally perpendicular to said substrate means opposite sides.

8. Apparatus as described in claim 7 wherein the capacitive effect of said capacitor means is augmented by successive layers of dielectric and conductor disposed over said capacitor means with no conductive coupling between said conductor layer and other parts of said phase shifter means.

9. Apparatus as described in claim 5 wherein said first and second diode means are so arranged as to be either simultaneously conducting or simultaneously non-conducting.

10. Phase shifter means comprising: substrate means having first and second opposed sides, ground plane means disposed on said first opposed side, transmission line apparatus disposed on said second opposed side including:

capacitor means, input and output transmission line means coupled to opposite sides of said capacitor means, first and second transmission line means respectively diirectly coupled to said input and output transmission line means at said capacitor means, first and second switching diode means respectively coupled to said first and second transmission line means opposite said capacitor means and to bias means, and third and fourth transmission line means respectively coupled to said first and second transmission line means at said diode means and to said ground plane means.

11. Apparatus as described in claim 10 wherein said capacitor means is characterized by a normalized susceptance b:

$$b=\tfrac{1}{2}(\cot \kappa L_1+\cot \kappa L_2)$$

wherein $\kappa$ is the propagation constant of said first, second, third, and fourth transmission line means and $L_1$ is the effective lengths of said first and third transmission line means.

12. Apparatus as described in claim 11 wherein:

$$\kappa L_1+\kappa L_2=90°.$$

13. Apparatus as described in claim 10 wherein said first and second switching diode means each has first and second simultaneous states according to the bias voltage level established simultaneously thereacross.

14. Apparatus as described in claim 13 wherein the incremental phase shift $\psi$ produced in said first and secnd diode switching states is:

$$\psi=2(\kappa L_2-\kappa L_1)$$

wherein $\kappa$ is the propagation constant of said first, second, third, and fourth transmission line means.

* * * * *